United States Patent [19]

Eigenmann

[11] Patent Number: 4,792,259

[45] Date of Patent: Dec. 20, 1988

[54] METHOD AND APPARATUS FOR DEPOSITING PREARRANGED RETROREFLECTING ELEMENTS ONTO A ROAD SURFACE

[76] Inventor: Helmut Eigenmann, Via Dufour 3, CH 6900 LUGANO, Switzerland

[21] Appl. No.: 942,647

[22] Filed: Dec. 17, 1986

[30] Foreign Application Priority Data

Dec. 18, 1985 [CH] Switzerland ..... 05386/85

[51] Int. Cl.[4] ..... E01C 23/16

[52] U.S. Cl. ..... 404/73; 404/94

[58] Field of Search ..... 404/9, 12, 15, 16, 73, 404/93, 94; 414/416; 221/73

[56] References Cited

U.S. PATENT DOCUMENTS

| | | | |
|---|---|---|---|
| Re. 31,291 | 6/1983 | Eigenmann | 404/14 |
| 3,590,701 | 7/1971 | Broeck | 404/94 X |
| 4,059,203 | 11/1977 | Wright | 221/73 |
| 4,072,403 | 2/1978 | Eigenmann | 350/105 |
| 4,136,991 | 1/1979 | Clark et al. | 404/15 X |
| 4,411,553 | 10/1983 | Eigenmann | 404/16 |
| 4,607,978 | 8/1986 | Eigenmann | 404/73 |
| 4,681,480 | 7/1987 | Eigenmann | 404/73 X |

FOREIGN PATENT DOCUMENTS

| | | | |
|---|---|---|---|
| 162452 | 11/1985 | European Pat. Off. | 404/12 |
| 22934 | 8/1982 | Italy . | |
| 25023 | 12/1982 | Italy . | |
| 637716 | 8/1983 | Switzerland . | |

*Primary Examiner*—Jerome W. Massie
*Assistant Examiner*—Matthew Smith
*Attorney, Agent, or Firm*—David H. Semmes

[57] ABSTRACT

The mechanical device used for carrying out the procedure consists of a reel (B), upon which is wound a conveyor sheet. Before the sheet is wound onto the said reel, the retroreflecting elements (A) are attached to it, maintaining a certain preestablished spacing between the elements. When the sheet is made to unwind from the reel (B) and passed over the sharp-edged body (C), the retroreflecting elements (A) are mechanically detached from the sheet and deposit themselves onto the road surface (S), maintaining the same preestablished spacing between them. The sheet, from which the retroreflecting elements have been detached, is then rewound onto the rewind reel (E).

The surface of the said sheet (B) can either be coated with an adhesive (sticky) substance, while the surfaces of the retroreflecting elements (A) are treated with a detaching polymer, or the sheet surface can be treated with the detaching polymer, with the surfaces of the retroreflecting elements coated with the adhesive (sticky) substance.

3 Claims, 1 Drawing Sheet

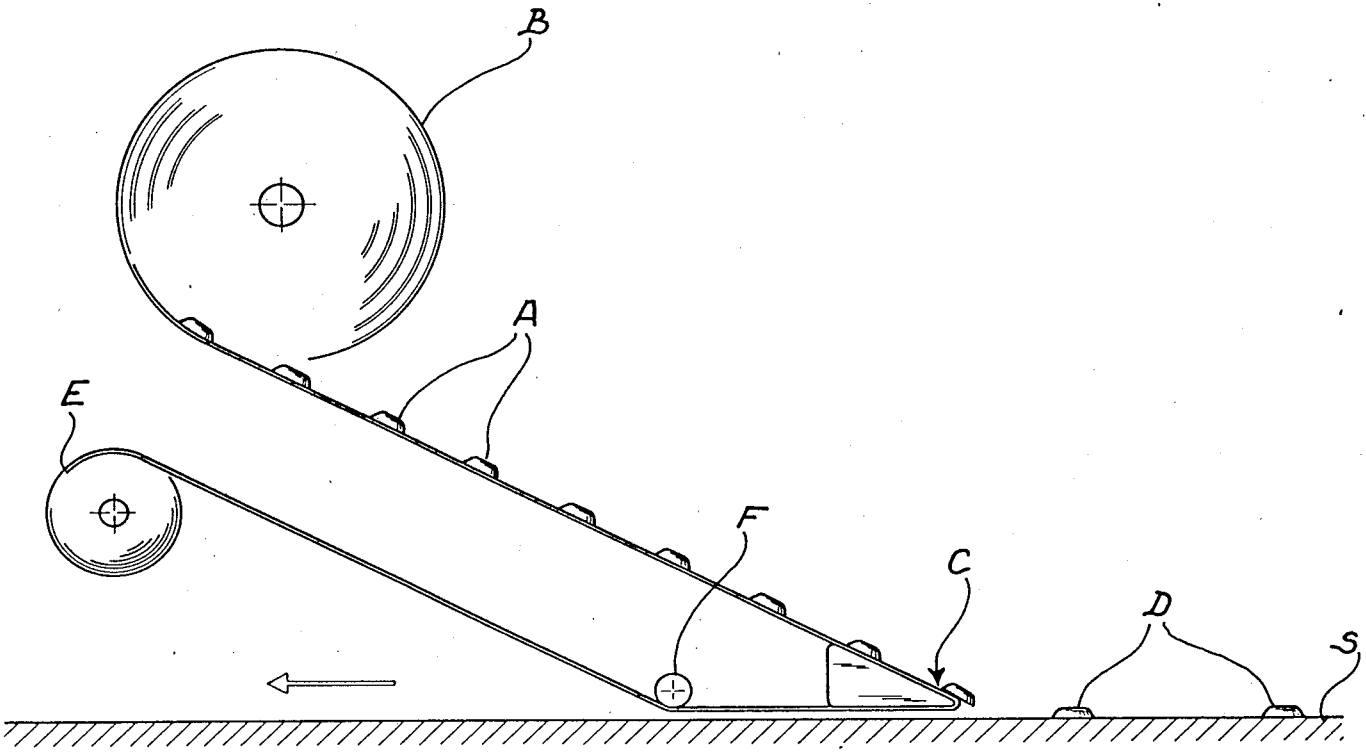
B
A
F
C
D
S
E

METHOD AND APPARATUS FOR DEPOSITING PREARRANGED RETROREFLECTING ELEMENTS ONTO A ROAD SURFACE

As is well known, many experiments have been carried out in the more evolved countries to try to improve night-driving safety, even under foggy and rainy conditions, by using special road markings designed to provide an efficacious guide for the motorist. It has not been possible to achieve this goal, however, using conventional materials. The difficulty has been due to the fact that whenever the retroreflecting elements, located on the marking strip, become covered with a film of water they no longer function as originally intended.

Mr. Ludwig Eigenmann has been awarded patents covering retroreflecting elements that are visible even under rainy conditions. These Patents include, for example, U.S. Pat. Nos. 4,072,403, 31,291, 4,411,553, 4,607,978; the Swiss Pat. No. 637,716; the European Pat. No. 83108302.7; and the Italian Pending Patents No. 22934 A/82 and 25023 A/82. With the conventional marking strips, inexpensive glass beads are haphazardly spread over the strip, but with Mr. Eigenmann's composite organic retroreflecting elements—which are necessarily more costly—these elements have to be so applied as to obtain the maximum retroreflecting efficiency.

Up to now, the depositing of the Eigenmann retroreflecting elements has been best done from an inclined-plane arrangement, using vibration or other means. The obtained road-mark-efficiency has been good and very much better than that obtained with the conventional types of retroreflecting elements. The obtained efficiency is very good under rainy conditions, but is not the maximum obtainable, due to imperfect mechanical depositing and consequent imperfect element positioning. The high cost of the elements does not permit obtaining an efficiency that is less than the maximum possible.

The object of this invention is a procedure for depositing horizontal retroreflecting road-marking elements—that are visible under rainy conditions—onto the road surface or onto road-marking materials applied to the road surface, positioned in such a way as to obtain maximum road-marking efficiency.

The procedure is characterized by the characterizing part of claim No. 1.

Detaching surfaces are those that have been appropriately treated with silicone resins, flouridated resins, or the like; self-adhesive surfaces are those treated with short-chain organic polymers—preferably ramified—in either the melted or plasticized state.

Another object of this invention is a device for carrying out the object procedure. This device is characterized by the characterizing part of claim No. 5.

The advantage of the procedure is that it permits the precise prepositioning of the retroreflecting elements on the conveyor sheet before reeling takes place, so that the angled blade which is located in the immediate vicinity of the road surface can detach the elements and faithfully reproduce the prepositioned configuration onto either an existing road-marking strip or on the road surface itself.

BRIEF DESCRIPTION OF THE DRAWING

The enclosed schematic diagram shows a preferred arrangement of the device for carrying out the object procedure.

DETAILED DESCRIPTION

The reeled conveyor sheet, upon which the retroreflecting elements "A" are positioned at preestablished distances, is indicated as "B". Sheet "B" passes over the sharp angle "C" and here is where the elements "A" are detached. The detached elements are indicated as "D" when deposited onto the road surface or existing road-marking strip, either one being indicated as "S".

After passing over the return roller "F", sheet "B" winds onto the rewind reel "E". This rewind reel is actuated by known means not shown in the diagram and draws sheet "B". The assembly is moved, in the direction shown by the arrow, at a speed commensurate with the speed of sheet "B", so as to obtain the desired distancing of the elements "D". The said movement is obtained by known means not shown in the diagram.

The prepositioning of the elements "A" on sheet "B" is done before reeling takes place, and is not disturbed during the unreeling phase, due to a certain degree of adherence provided by either the contact surface of the elements "A" or the contact surface of sheet "B". If the surface of sheet "B" has the adherence capability, the surfaces of the elements "A" will be treated with the detaching polymer. If the surfaces of the elements "A" have the adherence capability, the surface of sheet "B" will be treated with the detaching polymer.

If the elements "A" are treated with the detaching polymer, the road surface "S" will obviously have to be prepared with an appropriate adhesive substance.

As shown in the diagram, the best way to mechanically detach the elements "A" from the moving sheet "B" is by making sheet "B" pass over the sharp angle "C" of a blade.

When the elements "A" are detached as described above and fall onto the surface "S", their speed will be in the direction as shown by the arrow. This permits them to be correctly located onto this surface without overturning.

The advantage of the use of the sharp angle is that an immediate impulse is provided contemporaneously over the entire width of sheet "B", thus avoiding the occurrance of transverse displacement during the depositing phase. In this manner, the desired optimal arrangement on the surface "S" is obtained, as result of the combination of the arrangement on the sheet "B" with the translation speed of the assembly in the direction shown by the arrow.

The mechanical detaching of the elements can be obtained by some other means, but the results will be less satisfactory.

Besides obtaining particularly faithful results, both the procedure and the depositing device require only a modest investment.

I claim:

1. Method for precise depositing prearranged retroreflective road marking elements onto a road surface comprising:

a. prepositioning a plurality of retroreflective elements, having a detaching surface on their underside, in a predetermined orientation and spaced a predetermined distance on a conveyor sheet having an adhesive surface contacting the elements;

b. downwardly advancing said sheet to a zone in the vicinity of the road surface while maintaining said retroreflective elements in said predetermined orientation and distance, and moving said sheet at a predetermined speed longitudinally above the road surface; and c. detaching and depositing said retroreflective elements in the desired spacing on an adhesive road surface at said predetermined speed, while maintaining said orientation by drawing said conveyor sheet over an angled blade adjacent the road surface, so that the retroreflective elements adhere to the road surface by an adhesive.

2. Method for depositing prearranged retroflective road marking elements onto a road surface as in claim 1, wherein said depositing of the retroreflective elements is onto an already existing marking strip.

3. Method for depositing prearranged retroreflective road marking elements onto a road surface as in claim 2, wherein said detaching surface of said retroreflecting elements is a polymer.

* * * * *